US006299169B1

(12) United States Patent
Adams et al.

(10) Patent No.: US 6,299,169 B1
(45) Date of Patent: Oct. 9, 2001

(54) BOARD GAME UTILIZING A REMOTE CONTROL FOR A TELEVISION

(76) Inventors: Anthony Adams; Laura Campbell-Adams, both of Cape Hurd Road, Tobermory Ontario (CA), NOH2RO ( * ) Notice: Subject to any disclaimer, the term of this patent is extended or adjusted under 35 U.S.C. 154(b) by 0 days.

(21) Appl. No.: 09/616,795

(22) Filed: Jul. 14, 2000

Related U.S. Application Data

(60) Provisional application No. 60/146,939, filed on Aug. 2, 1999.

(51) Int. Cl.[7] ..... A63F 3/00
(52) U.S. Cl. ..... 273/248; 273/249
(58) Field of Search ..... 273/248, 249, 273/274

(56) References Cited

U.S. PATENT DOCUMENTS 4,640,513 * 2/1987 Montijo ..... 273/249
5,362,062 * 11/1994 Schott ..... 273/243
5,810,359 * 9/1998 Wilkins ..... 273/256
5,899,456 * 5/1999 Weinstock ..... 273/243

* cited by examiner

*Primary Examiner*—Benjamin H. Layno
*Assistant Examiner*—V K Mendiratta
(74) *Attorney, Agent, or Firm*—Goldstein Law Offices, P.C.

(57) ABSTRACT

A board game utilizing a remote control for a television including a game board shaped in a form of a televison remote control. The game board has planar upper and lower surfaces. The upper surface has a path of travel defined thereon. The path of travel includes a plurality of spaces thereon. The spaces include a starting point, an ending point, and a plurality of action spaces. The actions spaces include first action spaces and second action spaces. A plurality of playing pieces are provided which correspond with a number of participants for traveling around the path of travel of the game board. A playing die is provided to provide for movement of the playing pieces around the path of travel. A timer is provided for allotting a certain amount of time for each players turn. A plurality of first action cards correspond with the first action spaces of the game board. The first action cards indicate certain items to be found on a television using a remote control thereof. A plurality of second action cards correspond with the second action spaces of the game board. The second action cards indicate movements to be made by a player's particular playing piece.

1 Claim, 2 Drawing Sheets

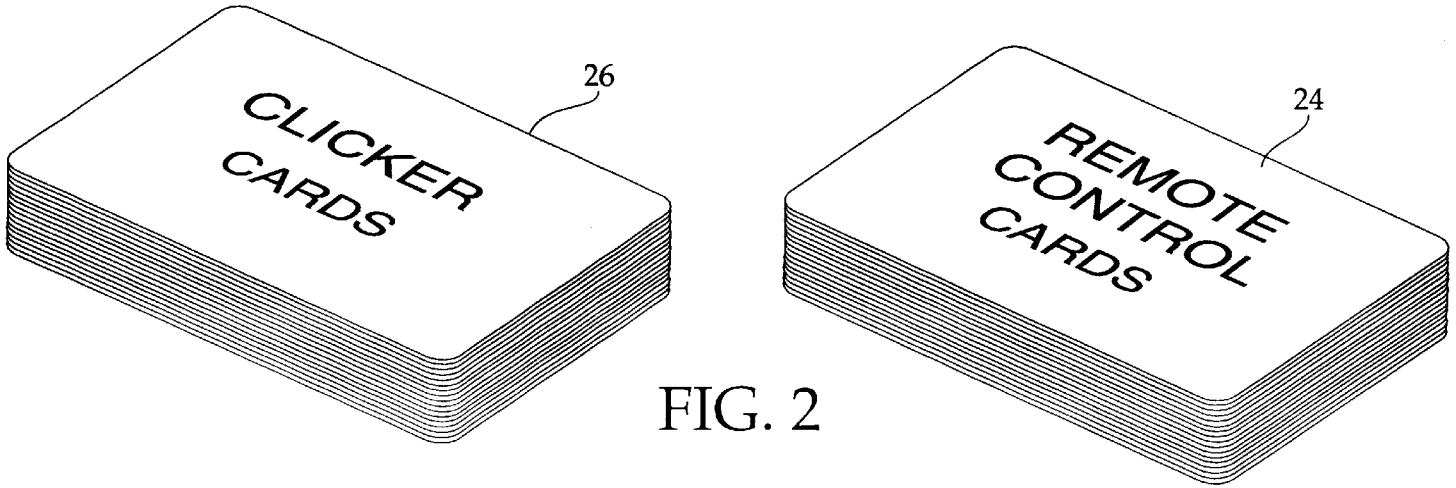
FIG. 2
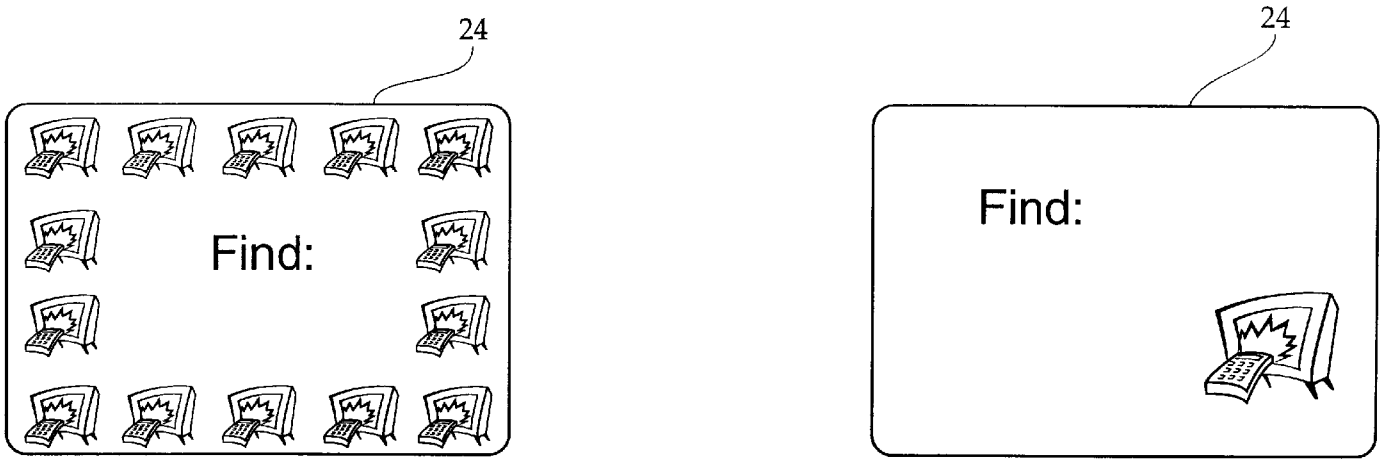
FIG. 3
FIG. 4

BOARD GAME UTILIZING A REMOTE CONTROL FOR A TELEVISION

CROSS REFERENCES AND RELATED SUBJECT MATTER

This application relates to subject matter contained in provisional patent application Ser. No. 60/146,939, filed in the United States Patent & Trademark Office on Aug. 2, 1999.

BACKGROUND OF THE INVENTION

The present invention relates to a board game utilizing a remote control for a television and more particularly pertains to playing a game that requires certain items to be found within a predetermined amount of time on television.

The use of televisions for amusement purposes is currently at an all-time high. Many families social lives revolve around the television. Many families have video cassette players that allow them to watch movies from their homes. Given the advent of the remote control, it is very easy for a person watching television to scan through many channels in order to find a desired program to watch. Thus, there seems to be a market for combining other amusement devices with the use of televisions.

Many people and families enjoy playing board games as a social activity. Thus, a good idea would be to combine a board game with a television whereby an objective of the game would be to find items on the television using a remote control in order to eventually win the game.

The present invention seeks to solve the abovementioned problem by providing a board game that requires participants to find certain items by scanning through the channels of a television in order to advance along a path of travel on the game board in order to ultimately win.

The use of board games is known in the prior art. More specifically, board games heretofore devised and utilized for the purpose of providing amusement are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,799,683 to Bruner, Jr. discloses a remote control device used in conjunction with a color television for playing a game. U.S. Pat. No. 4,890,842 to Plange discloses a board for a car racing game in which the cars are represented by pawns.

While these devices fulfill their respective, particular objective and requirements, the aforementioned patents do not describe a board game utilizing a remote control for a television for playing a game that requires certain items to be found within a predetermined amount of time on television.

In this respect, the board game utilizing a remote control for a television according to the present invention substantially departs from the conventional concepts and designs of the prior art, and in doing so provides an apparatus primarily developed for the purpose of playing a game that requires certain items to be found within a predetermined amount of time on television.

Therefore, it can be appreciated that there exists a continuing need for new and improved board game utilizing a remote control for a television which can be used for playing a game that requires certain items to be found within a predetermined amount of time on television. In this regard, the present invention substantially fulfills this need.

SUMMARY OF THE INVENTION

In the view of the foregoing disadvantages inherent in the known types of board games now present in the prior art, the present invention provides an improved board game utilizing a remote control for a television. As such, the general purpose of the present invention, which will be described subsequently in greater detail, is to provide a new and improved board game utilizing a remote control for a television and method which has all the advantages of the prior art and none of the disadvantages.

To attain this, the present invention essentially comprises a game board shaped in a form of a televison remote control. The game board has planar upper and lower surfaces. The upper surface has a path of travel defined thereon. The path of travel includes a plurality of spaces thereon. The spaces include a starting point, an ending point, and a plurality of action spaces. The actions spaces include first action spaces and second action spaces. A plurality of playing pieces are provided which correspond with a number of participants for traveling around the path of travel of the game board. A playing die is provided to provide for movement of the playing pieces around the path of travel. A timer is provided for allotting a certain amount of time for each players turn. A plurality of first action cards correspond with the first action spaces of the game board. The first action cards indicate certain items to be found on a television using a remote control thereof. A plurality of second action cards correspond with the second action spaces of the game board. The second action cards indicate movements to be made by a player's particular playing piece.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved board game utilizing a remote control for a television which has all the advantages of the prior art board games and none of the disadvantages.

It is another object of the present invention to provide a new and improved board game utilizing a remote control for a television which may be easily and efficiently manufactured and marketed.

It is a further object of the present invention to provide a new and improved board game utilizing a remote control for a television which is of durable and reliable construction.

An even further object of the present invention is to provide a new and improved board game utilizing a remote control for a television which is susceptible of a low cost of manufacture with regard to both materials and labor, and which accordingly is then susceptible of low prices of sale to the consuming public, thereby making such a board game utilizing a remote control for a television economically available to the buying public.

Even still another object of the present invention is to provide a new and improved board game utilizing a remote control for a television for playing a game that requires certain items to be found within a predetermined amount of time on television.

Lastly, it is an object of the present invention to provide a new and improved board game utilizing a remote control for a television including a game board shaped in a form of a televison remote control. The game board has planar upper and lower surfaces. The upper surface has a path of travel defined thereon. The path of travel includes a plurality of spaces thereon. The spaces include a starting point, an ending point, and a plurality of action spaces. The actions spaces include first action spaces and second action spaces. A plurality of playing pieces are provided which correspond with a number of participants for traveling around the path of travel of the game board. A playing die is provided to provide for movement of the playing pieces around the path of travel. A timer is provided for allotting a certain amount of time for each players turn. A plurality of first action cards correspond with the first action spaces of the game board. The first action cards indicate certain items to be found on a television using a remote control thereof. A plurality of second action cards correspond with the second action spaces of the game board. The second action cards indicate movements to be made by a player's particular playing piece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the first and second set of action cards of the present invention.

FIG. 3 is a plan view of one of the first action cards typifying a specific action required.

FIG. 4 is a plan view of one of the second action cards typifying a specific action required.

The same reference numerals refer to the same parts through the various figures.

DESCRIPTION OF THE PREFERRED EMBODIMENT

Figure 1:
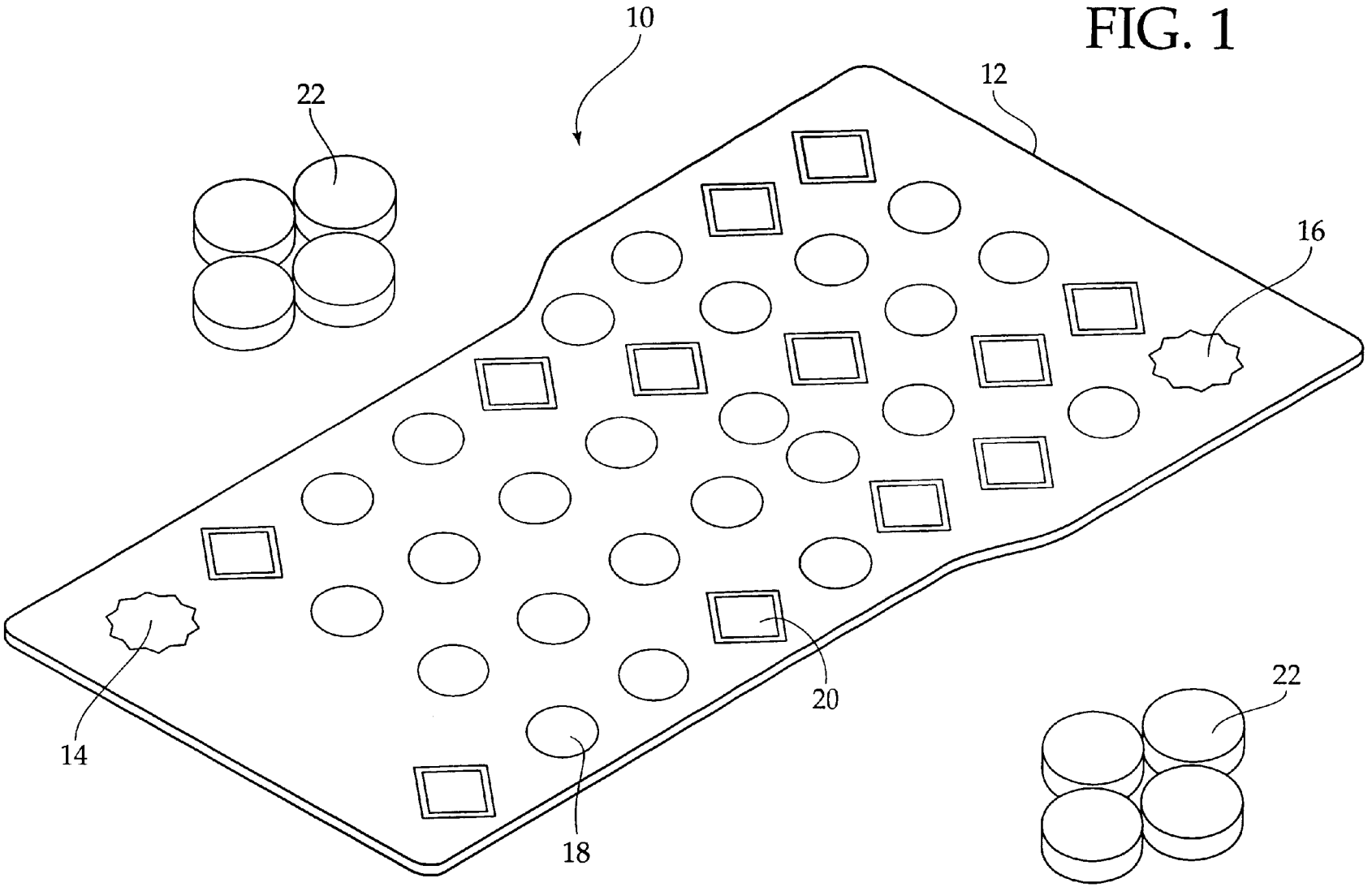
FIG. 1 is a perspective view of the preferred embodiment of the board game utilizing a remote control for a television constructed in accordance with the principles of the present invention.

With reference now to the drawings, and in particular, to FIGS. 1 through 4 thereof, the preferred embodiment of the new and improved board game utilizing a remote control for a television embodying the principles and concepts of the present invention and generally designated by the reference number 10 will be described.

Specifically, it will be noted in the various Figures that the device relates to a board game utilizing a remote control for a television for playing a game that requires certain items to be found within a predetermined amount of time on television. In its broadest context, the device consists of a game board, a plurality of playing pieces, a playing die, a timer, a plurality of first action cards, and a plurality of second action cards. Such components are individually configured and correlated with respect to each other so as to attain the desired objective.

The game board 12 is shaped in a form of a televison remote control. Note FIG. 1. The game board 12 has planar upper and lower surfaces. The upper surface has a path of travel defined thereon. The path of travel includes a plurality of spaces thereon. The spaces include a starting point 14, an ending point 16, and a plurality of action spaces. The actions spaces include first action spaces 18 and second action spaces 20.

The plurality of playing pieces 22 are provided which correspond with a number of participants for traveling around the path of travel of the game board 12.

The playing die would be used to provide for movement of the playing pieces 22 around the path of travel.

The timer would be used for allotting a certain amount of time for each players turn.

The plurality of first action cards 24 correspond with the first action spaces 18 of the game board 12. The first action cards 24 indicate certain items to be found on a television using a remote control thereof. The first action cards 24 would be referred to as remote control cards which indicate different items to be found on the television. When the playing piece lands on a first action space 18, which resemble circles, the player is required to use the remote control to surf the channels until the item is found. When the item is found, the player then rolls the die and continues. The playing piece 22 cannot be moved until item on the card 24 has been found during a specified time. The time will be monitored using the timer or other timing mechanism.

The plurality of second action cards 26 correspond with the second action spaces 20 of the game board 12. The second action cards 26 indicate movements to be made by a player's particular playing piece 22. The second action cards 26 are referred to as clicker cards and the second action spaces 20 resemble commands on a remote control unit. The second action cards 26 will instruct the player on what to do next: i.e., T.V. repairman sets you back two spaces. Thus, the player moves their playing piece 22 back two spaces on the game board 12.

The player who reaches the ending space 16 first must then select a remote control or first action card 24. If the item is successfully found, that player is the winner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A board game utilizing a remote control for a television for playing a game that requires certain items to be found within a predetermined amount of time on television comprising, in combination:

a game board shaped in a form of a televison remote control, the game board having planar upper and lower surfaces, the upper surface having a path of travel defined thereon, the path of travel including a plurality of spaces thereon, the spaces including a starting point, an ending point, and a plurality of action spaces, the actions spaces including first action spaces and second action spaces;

a plurality of playing pieces corresponding with a number of participants for traveling around the path of travel of the game board;

a playing die;

a timer;

a plurality of first action cards corresponding with the first action spaces of the game board, the first action cards indicating certain items to be found on a television using a remote control thereof;

a plurality of second action cards corresponding with the second action spaces of the game board, the second action cards indicating movements to be made by a player's particular playing piece.

* * * * *